US009909244B2

(12) United States Patent
Gueller et al.

(10) Patent No.: US 9,909,244 B2
(45) Date of Patent: Mar. 6, 2018

(54) WASHING METHOD AND WASHING DEVICE

(71) Applicant: Chemspeed Technologies AG, Augst (CH)

(72) Inventors: Rolf Gueller, Herznach (CH); Daniel Juchli, Kaiseraugst (CH); Carine Marcos, Bartenheim (FR)

(73) Assignee: Chemspeed Technologies AG, Füllinsdorf (CH)

( * ) Notice: Subject to any disclaimer, the term of this patent is extended or adjusted under 35 U.S.C. 154(b) by 163 days.

(21) Appl. No.: 14/774,214

(22) PCT Filed: Mar. 7, 2014

(86) PCT No.: PCT/EP2014/054421
§ 371 (c)(1),
(2) Date: Sep. 10, 2015

(87) PCT Pub. No.: WO2014/139871
PCT Pub. Date: Sep. 18, 2014

(65) Prior Publication Data

US 2016/0017528 A1 Jan. 21, 2016

(30) Foreign Application Priority Data

Mar. 13, 2013 (CH) ..... 593/13

(51) Int. Cl.
*D06F 21/08* (2006.01)
*D06F 21/10* (2006.01)
(Continued)

(52) U.S. Cl.
CPC ..... *D06F 23/06* (2013.01); *D06F 21/08* (2013.01); *D06F 21/10* (2013.01); *D06F 31/00* (2013.01);
(Continued)

(58) Field of Classification Search
CPC ..... D06F 21/08; D06F 21/10; D06F 23/06; D06F 31/00; D06F 35/00; D06F 35/005;
(Continued)

(56) References Cited

U.S. PATENT DOCUMENTS 5,093,948 A * 3/1992 Val ..... 68/29
2003/0067838 A1 4/2003 Schmidt
(Continued)

FOREIGN PATENT DOCUMENTS

DE 10143439 A1 3/2003
DE 10206620 A1 9/2003
(Continued)

OTHER PUBLICATIONS

CosSearch GmbH, SpeedMixer™, available at http://www.speedmixer.ch/doc/SPEEDMIXER_SYSTEM_NEU_01E.pdf.
(Continued)

*Primary Examiner* — Levon J Shahinian
(74) *Attorney, Agent, or Firm* — The Webb Law Firm

(57) ABSTRACT

The invention relates to a method and a device for washing textile items to be washed, wherein the items to be washed and a washing liquid are introduced into a washing container. Then the washing container is dually asymmetrically centrifuged. During the dual asymmetrical centrifuging, the washing container is rotated about a first axis of rotation, which extends outside of the washing container, and simultaneously about a second axis of rotation, which extends through the washing container and is at an acute angle to the first axis of rotation. The washing process is thereby intensified and significantly accelerated.

20 Claims, 6 Drawing Sheets

(51) Int. Cl.

| | |
|---|---|
| ***D06F 23/06*** | (2006.01) |
| ***D06F 31/00*** | (2006.01) |
| ***D06F 35/00*** | (2006.01) |
| ***D06F 37/02*** | (2006.01) |
| ***D06F 37/08*** | (2006.01) |
| ***D06F 37/16*** | (2006.01) |
| ***D06F 37/30*** | (2006.01) |
| ***D06F 39/00*** | (2006.01) |

(52) U.S. Cl.
CPC ..... *D06F 35/00* (2013.01); *D06F 35/005* (2013.01); *D06F 37/02* (2013.01); *D06F 37/08* (2013.01); *D06F 37/16* (2013.01); *D06F 37/30* (2013.01); *D06F 39/004* (2013.01)

(58) Field of Classification Search
CPC ..... D06F 37/02; D06F 37/08; D06F 37/16; D06F 37/30; D06F 39/004
USPC ..... 8/158, 159; 68/27, 29, 139
See application file for complete search history.

(56) References Cited

U.S. PATENT DOCUMENTS

| | | | |
|---|---|---|---|
| 2005/0076707 | A1 | 4/2005 | Blum et al. |
| 2008/0280315 | A1 | 11/2008 | Knotzel et al. |
| 2009/0281663 | A1 | 11/2009 | Robida |

FOREIGN PATENT DOCUMENTS

| | | | |
|---|---|---|---|
| EP | 1340063 | A1 | 9/2003 |
| JP | 2000246082 | A | 9/2000 |
| WO | 0242740 | A1 | 5/2002 |

OTHER PUBLICATIONS

Hauschild Engineering, SpeedMixer™, Hauschild & Co KG http://www.speedmixer.de, various pages retrieved Oct. 12, 2012.

* cited by examiner

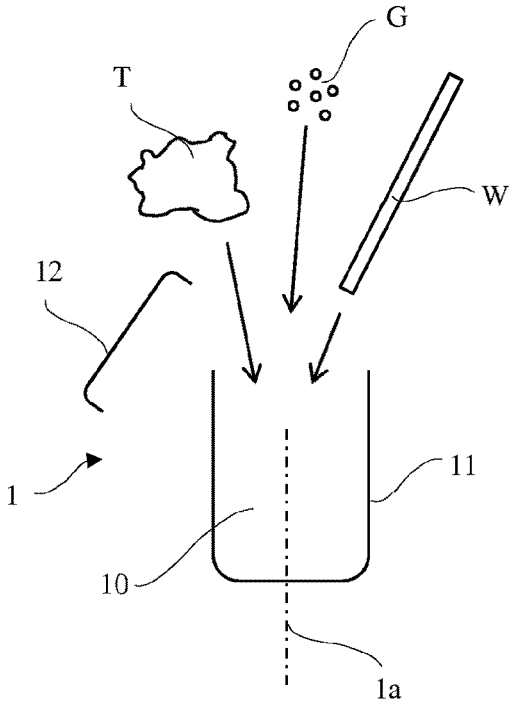
Fig. 1
Fig. 2
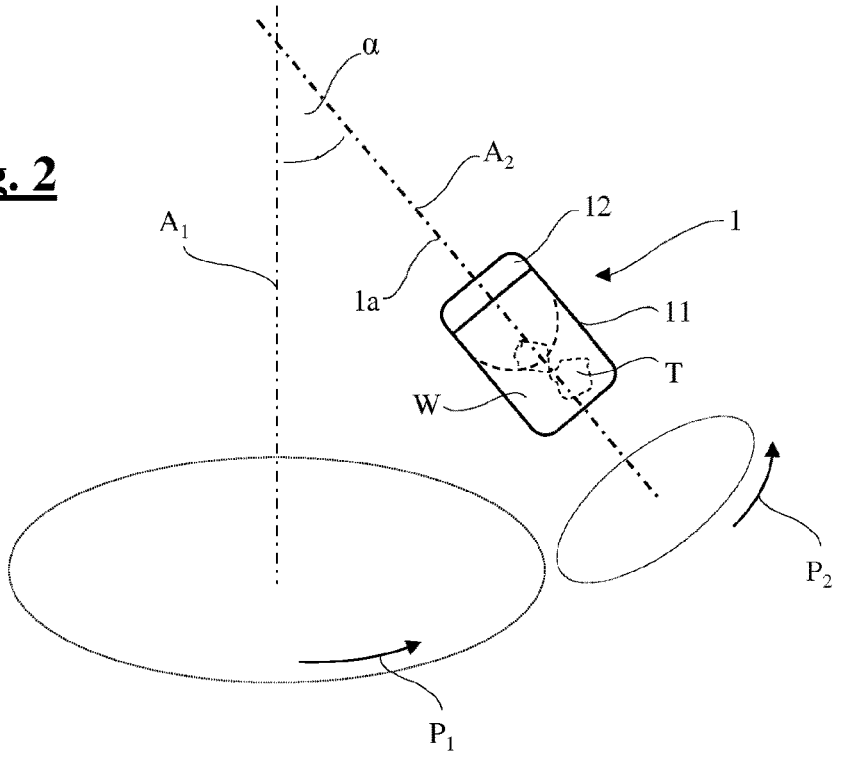

Fig. 5a
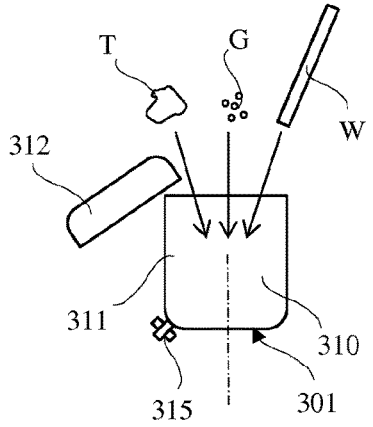
Fig. 5b
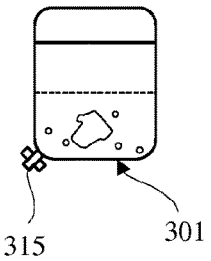
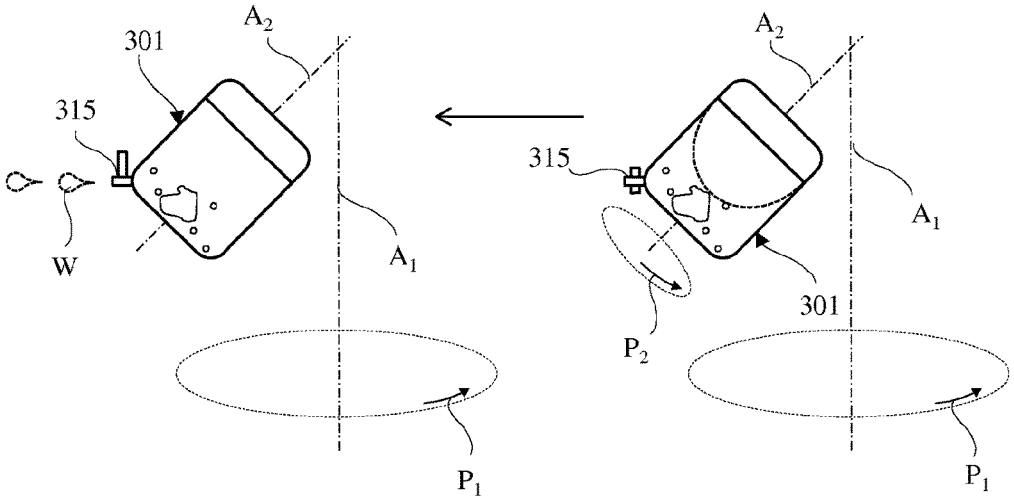
Fig. 5d
Fig. 5c

Fig. 8
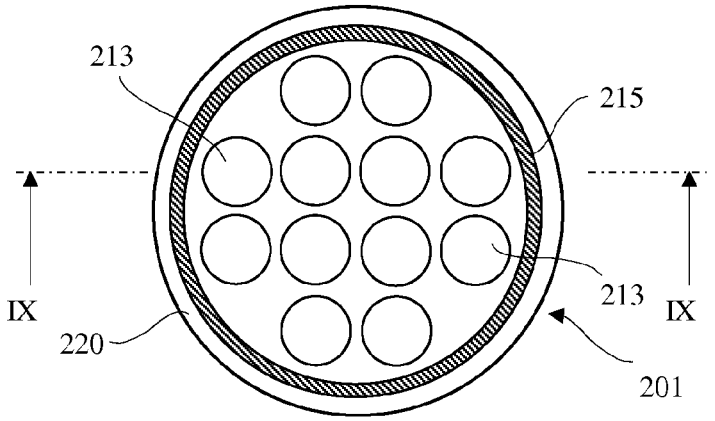
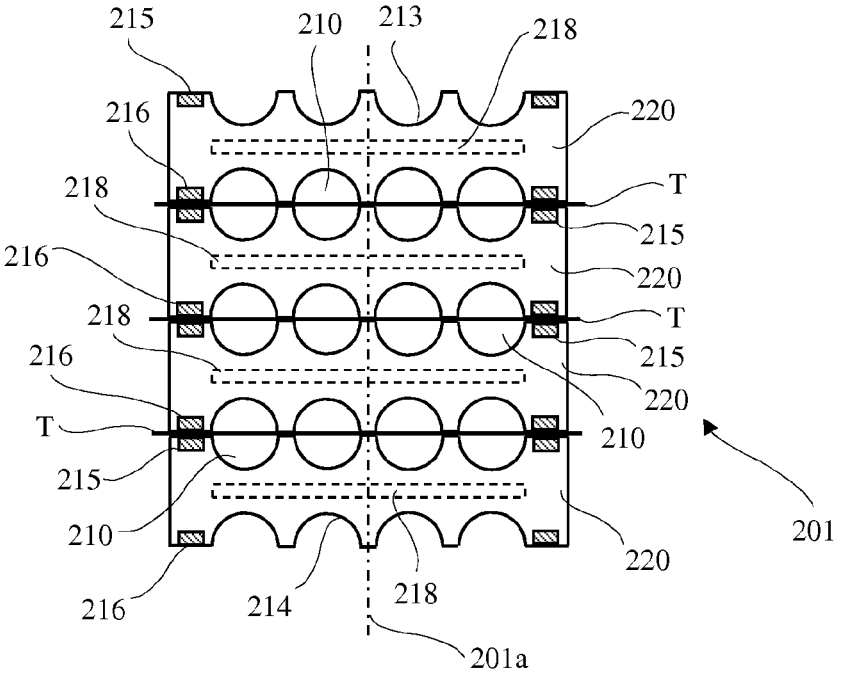
Fig. 9

WASHING METHOD AND WASHING DEVICE

CROSS-REFERENCE TO RELATED APPLICATIONS

This application is the United States national phase of International Application No. PCT/EP2014/054421 filed Mar. 7, 2014, and claims priority to Switzerland Patent Application No. 593/13 filed Mar. 13, 2013, the disclosures of which are hereby incorporated in their entirety by reference.

BACKGROUND OF THE INVENTION

Field of the Invention

The present invention relates to a method and a device for washing textile laundry items.

Description of Related Art

In the detergent industry, work is ongoing on the improvement of active washing substances, mixtures of substances and detergent formulations. The testing of the effectiveness of the active washing substances, etc. is thereby usually executed by means of test washings, whereby a washing fluid is prepared from the active washing substance or formulation, and then textile laundry items (substrate) contaminated in a specific manner are washed with this washing fluid under defined conditions (e.g. temperature). The washed textile items are then examined with regard to the effectiveness of the active washing substance under the applied conditions. In order to be able to examine as many active washing substances as possible in different formulations and concentrations, and in combination with different textile substrates, very large numbers of test washings are often required, which in total require a very large amount of time. This is undesirable, in particular for reasons of costs. A further disadvantage during the washing process—regardless of whether this occurs in research and development of washing products, or in the effective application itself—is that the washing methods of today's known art are normally based on significant mechanical actions on the washing items, as a result of which the latter become worn.

DE 102 06 620 A1 discloses a device and a method for testing the impact of fluids on a fabric, in which the fabric is arranged between two elements having depressions. The depressions form chambers in which the fluids to be tested are located. The elements, with the fabric located in between, are suspended on a shaft and are rotated for testing the impact of the fluids. In order to increase the fluid exchange between the chamber segments divided by the fabric, a small hole can advantageously be placed into the fabric in the wetted region.

Based on the above, the task underlying the invention is to provide a more efficient, very effective washing method requiring short washing times, as well as to provide a corresponding washing device for textile laundry items, which moreover lay the foundations for automated handling, and also do not have a negative influence on the laundry items being washed as a result of mechanical action. It should be possible to do without the placement of holes into the laundry items.

SUMMARY OF THE INVENTION

In its basic embodiment, the method according to the invention for washing textile laundry items comprises the following steps:

- Introduction of the laundry items and a washing fluid in a ready-to-use form, or in form of components, into a washing cell of a washing container, and
- Dual asymmetric centrifugation of the washing container loaded with the laundry items and the washing fluid, whereby the washing container is rotated about a primary axis running outside of the washing container, and at the same time about a secondary axis running through the washing container and being arranged at an acute angle to the primary axis.

In the washing method according to the invention, the washing process takes place not primarily in a traditional manner by mechanical movement of the laundry items within the washing container, but on the basis of diffusion, i.e. by accelerated diffusion of the washing fluid through the laundry items and of the contamination out of the laundry items. The diffusion of the washing fluid is achieved by the combination of the acceleration forces caused by the dual asymmetric centrifugation in two different planes. By applying the principle of dual asymmetric centrifugation according to the invention, the washing process is intensified and significantly accelerated, so that the actual washing process only requires a very short amount of time (typically about 1 minute or less).

The secondary axis preferably runs as centrally as possible through the washing container, thus, in the case of a cylindrical washing container, through the cylindrical axis of the washing container. Thereby, imbalances are avoided as far as possible.

In accordance with an advantageous embodiment of the invention, the laundry items are arranged fixed or also planarised in the washing container and are washed in the fixed or planarised state. In particular the laundry items are spanned in the washing container for this purpose, such that within the washing cell of the washing container they are essentially fixed or planar. This causes that the laundry items are not crumpled as a result of the washing process itself. This has the advantage that after the washing process the laundry items are still fixed or planar and, therefore, can be examined directly and without any further preparation e.g. with regard to the washing results.

In accordance with a further advantageous embodiment of the invention, a washing container provided with two or more washing cells is used, into which washing cells the laundry items and washing fluid are introduced in each case. The use of such a washing container with several washing cells has the advantage that washing can be executed simultaneously in series in a single washing process.

Advantageously, a washing container is used thereby whose washing cells are arranged within the washing container in two or more planes. This allows the accommodation of many washing cells in a relatively small washing container, this is particularly advantageous if commercial centrifuges are to be deployed in which the size of the washing container is subject to limitations.

In accordance with a further advantageous embodiment of the invention, at least partially different washing fluids and/or at least partially different laundry items are introduced into the washing cells. This allows simultaneous test washings in series with different washing fluids and/or different laundry items.

In accordance with a further advantageous embodiment of the invention, an inert granular material, in particular in form of glass beads, is additionally introduced into the washing cell or the washing cells of the washing container. Thereby, the grains or beads, acting as washing bodies, increase the washing effect.

In accordance with a further advantageous embodiment of the invention, the temperature of the washing fluid in the washing cell or washing cells of the washing container can be controlled during the washing process. This can be implemented, for example, by heating means and/or cooling means provided in the washing container. Thus, the effectiveness of the washing fluid can be examined under various temperature conditions.

Alternatively, the temperature of the washing fluid in the washing container can also be adjusted to a desired set value before the washing process, and can then be held constant during the washing process, whereby the latter can be achieved by the deployment of a thermally insulated washing container.

Advantageously, the profile of the temperature of the washing fluid can be recorded during the washing process.

Advantageously, after the washing, the washing fluid is discharged from the washing cell or washing cells of the washing container by single-axis centrifugation. This has the advantage that the washed laundry items can be removed from the washing container in a practically dry state.

Advantageously, a washing container is used having at least one drainage opening that can be opened and closed, whereby the drainage opening is held open during the single-axis centrifugation.

It is particularly advantageous if the washing process is executed in a device centrifuging in a dual asymmetric manner about two axes, and, after the washing process, the discharging of the washing fluid is executed in the same device, wherein during the discharging of the washing fluid the device only centrifuges about one of the two axes.

With regard to the washing device, the essence of the invention consists in the following: A device for washing textile laundry items comprises

- a washing container for accommodating the laundry items and a washing fluid in a ready-to-use form or in form of individual components, wherein the washing container has means for fixing the laundry items,
- means for mounting the washing container, and
- means for dual asymmetric centrifugation of the washing container about a primary axis and a secondary axis, wherein the primary axis runs outside of the washing container, and the secondary axis runs through the washing container and is arranged at an acute angle to the primary axis.

According to a preferred embodiment, the washing device is designed to be switchable between a first and a second mode of operation, wherein in the first mode of operation the washing container rotates about both axes, and wherein in the second mode of operation the washing container only rotates about one of the two axes, preferably about the primary axis.

According to a further preferred embodiment, the washing device has a first drive means for a rotative drive of the washing container about the primary axis, and a second drive means, which can be coupled with and decoupled from the first drive means, for a rotative drive of the washing container about the secondary axis.

Advantageously, the washing container is designed with at least one drainage opening, which can be closed and opened, for discharging washing fluid from the washing container.

Furthermore, it is advantageous if the means for fixing the laundry items are means for fixing the laundry items in a planarised manner.

Expediently, the washing container has two or more washing cells for accommodating the laundry items and the washing fluid.

The washing method according to the invention and the washing device according to the invention are in particular provided for the execution of test washings in the research and development of, for example, the detergent industry. However, they can also be applied to other washing processes in principle.

In the following, the washing method according to the invention and the washing device according to the invention are described in more detail on the basis of exemplary embodiments with reference to the accompanying Figures. It is shown in:

BRIEF DESCRIPTION OF THE DRAWINGS

FIGS. 1-2 a schematic representation of a first exemplary embodiment of the washing method according to the invention;

FIGS. 5*a*-5*d* a schematic representation of a second exemplary embodiment of the washing method according to the invention;

FIGS. 8-9 a variant of a washing container in two cross-sectional representations;

Figure 3:
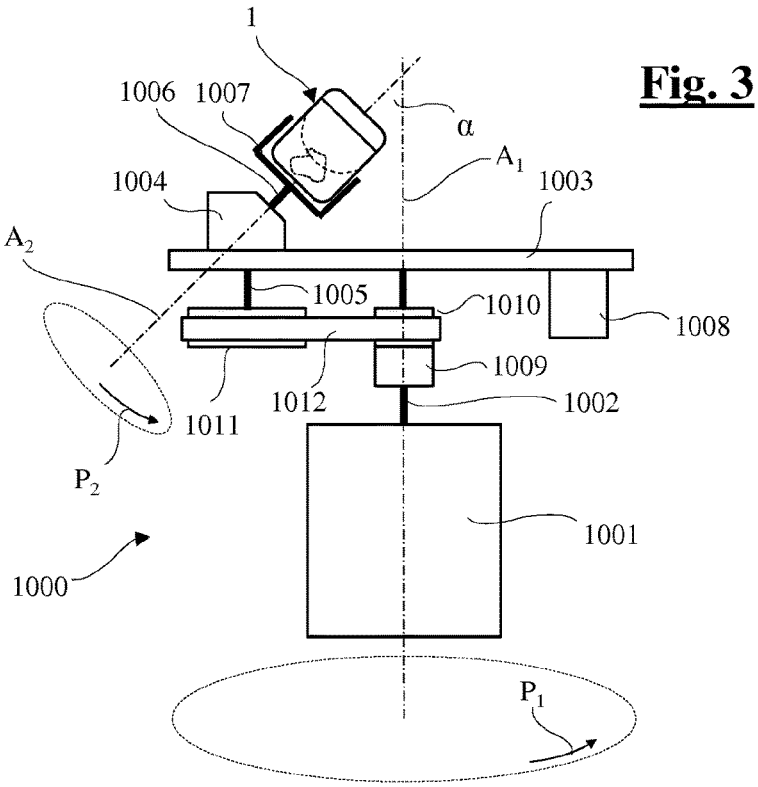
FIGS. 3-4 a schematic representation of a first exemplary embodiment of the washing device according to the invention.

For the following description, the following definition applies: If in a Figure for purposes of figurative clarity reference signs are specified, but are not referred to in the immediately related part of the description, then reference is made to their explanation in preceding or following parts of the description. Vice versa, for purposes of avoiding figurative overload, reference signs less relevant for immediate comprehension are not inscribed in all Figures. Hereto, reference is made to the other Figures in each case.

DESCRIPTION OF THE INVENTION

The basic steps of the washing method according to the invention are represented in FIGS. 1 and 2.

In a preparatory step, according to FIG. 1, textile laundry items T which have to be washed are introduced into a washing container that is open initially. Likewise, a measured quantity of a washing fluid, either in a ready-to-use form, or in the form of individual components, is introduced into the washing container 1. The washing container 1 typically has a cylindrical shape, and comprises a cup-shaped base section 11 and a cover section 12. The axis of the washing container 1 is designated as 1*a*. The interior of the washing container 1 forms a washing cell 10.

The washing container 1 is then tightly sealed by placing the cover 12 onto the base section 11. The means provided on both, the container and cover, for tightly fixing the cover are conventional and in the interests of simplicity are not represented. The closure of the washing container is not absolutely essential, depending upon the loading and shape of the washing container.

The following actual washing step is outlined in FIG. 2. Thereby, the closed (or, on occasions, open) washing container 1, together with the laundry items T and the washing fluid W located inside it, are subject to a dual asymmetric centrifugation. This is to be understood to mean that the washing container 1 is simultaneously rotated about two axes of rotation A1 and A2. The first, primary axis of rotation A1 runs outside of the washing container 1, such that the washing container 1 thus circulates as a whole on a circular path about the primary axis of rotation A1. This circular movement is indicated by the arrow P1. The second, secondary axis of rotation A2 runs through the washing container 1, and preferably coincides with the latter's own axis 1*a*. The secondary axis of rotation A2 is spatially oriented such that it includes with the primary axis of rotation A1 an acute angle $\alpha$ of between 10° and 80°, preferably of between 20° and 70°, more preferably of between 30° and 60°, typically approx. 40°. Thus the washing container 1 also rotates at the same time about its own axis, wherein this rotational movement is indicated by the arrow P2.

The said dual asymmetric centrifugation is now executed for a predetermined washing time. By virtue of the centrifugal forces thereby occurring, acting in two different planes, the washing fluid W diffuses backwards and forwards multiple times through the textile laundry items T, whereby a very intensive washing action is achieved, in that the contamination diffuses very rapidly out of the laundry items and is homogeneously distributed in the washing fluid.

The rotational velocities about the two axes of rotation A1 and A2 are empirically adjusted such that on the one hand the centrifugal accelerations are as high as possible, and the washing durations (centrifugation durations) are as short as possible, but on the other hand the laundry items are not damaged. Values for the centrifugal accelerations from 30 up to 5000 m/s$^2$, preferably from 2500 up to 3500 m/s$^2$, are values that can be used in practice. Thereby it is possible to achieve washing times of about 1 minute, or even less.

After the dual asymmetric centrifugation, the washing container 1 is opened (inasmuch as it had previously been closed) and the washed laundry items T, together with the washing fluid W, are removed, whereby the washing fluid is usually disposed of or, if required, is also analysed e.g. as to how defined contamination is bound by the washing fluid, or what concentrations are present. The emptying of the washing container 1 can preferably be undertaken by means of centrifugation.

In the following, with the aid of FIGS. 3 and 4, an exemplary embodiment of a washing device according to the invention that is particularly well suited to the execution of the method according to the invention is described in more detail, whereby only the functionally essential components of the washing device are represented in the Figures.

The washing device, the whole of which is designated as 1000, is constructed in the form of a centrifuge and comprises a rotary plate 1003, which can be rotationally driven by a motor 1001 via a shaft 1002. An angled gear unit 1004 having an input shaft 1005 and an output shaft 1006 is arranged on the rotary plate 1003. A washing container 1 is mounted in a socket 1007 made for accommodating the washing container, said socket is connected with the output shaft in a torque-proof manner and is sitting on the output shaft 1006. An out-of-balance compensation weight 1008 is arranged under the rotary plate 1003, diametrically opposite to the angled gear unit 1004. The shaft 1002 driven by the motor 1001 passes through a coupling element 1009 being stationary with respect to rotation and said shaft passes through a pulley 1010 being free to rotate on the shaft 1002. On the input shaft 1005 of the angled gear unit 1004, a further pulley 1011 sits which is coupled with the drive shaft in a torque-proof manner. The two pulleys 1010 and 1011 are coupled with one another in terms of rotation via a drive belt 1012. The axes of rotation of the shaft 1002, or of the rotary plate 1003, and of the output shaft 1006 of the angled gear unit 1004, include an acute angle $\alpha$ and correspond to the primary and secondary axes A1 and A2, respectively, see FIG. 2.

The motor 1001, the shaft 1002, and the rotary plate 1003 form first drive means for purposes of the rotative drive of the washing container 1 about the primary axis A1. The angled gear unit 1004, the output shaft 1006, the input shaft 1005, the pulley 1011, the drive belt 1012, and the pulley 1009 form second drive means that can be coupled with, or decoupled from, the first drive means for purposes of the rotative drive of the washing container about the secondary axis A2.

In the mode of operation of the washing device represented in FIG. 3, the stationary coupling element 1009 is connected with the pulley 1010 such that the latter cannot rotate. If the rotary plate 1003 rotates about the primary axis A1, the angled gear unit 1004 moves along a circular path about the stationary pulley 1010, as a result of which the pulley 1011 is driven. Via the angled gear unit 1004, the rotational movement of the pulley 1011 is transferred onto the socket 1007 made for accommodating the washing container, and thus onto the washing container 1. In this mode of operation of the washing device, therefore, the washing container 1 rotates, as described in connection with FIG. 2, simultaneously about two axes, namely the primary axis A1 and the secondary axis A2. The corresponding rotational movements are symbolised by arrows P1 and P2, in an analogous manner to FIG. 2. In this mode of operation, the washing device represents a centrifuge operating in a dual asymmetric manner.

Figure 4:
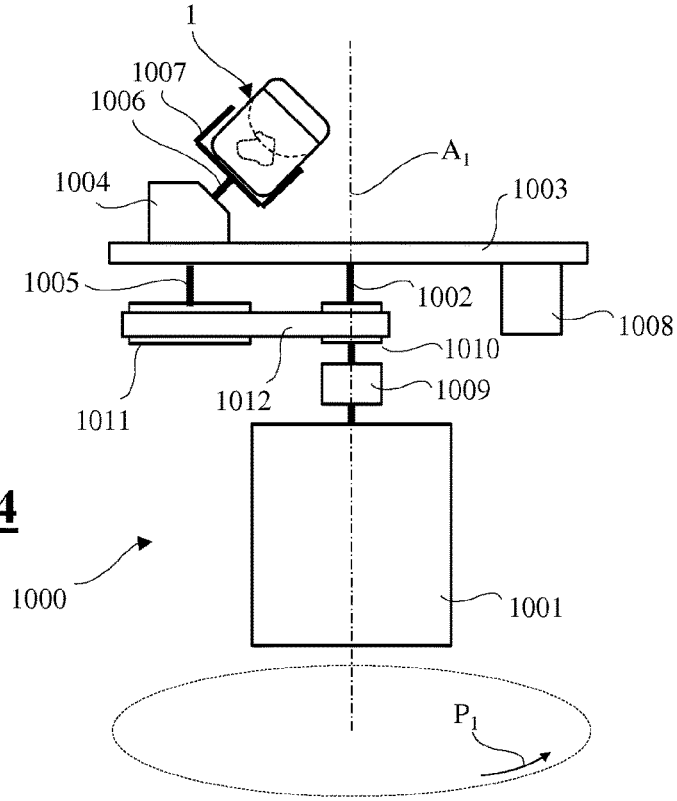

In the mode of operation of the washing device represented in FIG. 4, the stationary coupling element 1009 is decoupled from the pulley 1010, which in the Figure is indicated by a position of the coupling element 1009 that is somewhat displaced axially. The pulley 1010 can now rotate freely on the shaft 1002. The pulley 1010 now rotates together with the circulatory movement of the pulley 1011, and can thus no longer drive the latter in a rotational manner. Thus, in this mode of operation of the washing device, the washing container 1 no longer rotates about the secondary axis A2, i.e. about its own axis, but only rotates about the primary axis A1, whereby the rotational movement about this axis is symbolised by the arrow P1. In this mode of operation, the washing device represents a traditional single-axis centrifuge.

The switching between the two modes of operation of the washing device is undertaken in a very simple constructional manner by the coupling, or decoupling, respectively, of the pulley 1010 and the coupling element 1009. The coupling can, for example, be implemented electromagnetically.

A great advantage of the washing device according to the invention consists in the fact that both the washing step undertaken under dual asymmetric centrifugation and also the emptying of the washing container by traditional centrifugation can be executed in one and the same device, so that on the one hand no separate devices are required, and on the other hand handling is significantly simplified.

By a simple deactivation of the rotation of the washing container about one of the two axes A1 or A2, preferably the rotation about the secondary axis A2, the switching is made from diffusion to centrifugation, that is to say, from a mixing of the content of the washing container caused by diffusion, to a separation of the washing fluid.

In FIGS. 5*a*-5*d* the steps of the washing method according to the invention to be executed with the deployment of the washing device according to the invention are once again schematically summarised. FIG. 5*a* shows the preparatory steps in an analogous manner to FIG. 1. Here, a washing container 301 is deployed with a base section 311 and a cover section 312, together with a washing cell 310. In addition, the washing container is fitted with a drainage opening that can be shut off and which is symbolised by a valve 315 in the Figures. At the start of, and during, the washing process the valve 315 is closed.

FIG. 5*b* shows the washing container 301 in the closed state. The latter is inserted into the washing device according to the invention and dual asymmetrically centrifuged, whereby it rotates about the two axes A1 and A2 (FIG. 5*c*).

After the washing process has ended, the mode of operation of the washing device is switched from dual asymmetric centrifugation to a traditional single-axis centrifugation, whereby the washing container 301 only continues to rotate about the primary axis A1. During the switching of the mode of operation of the washing device, the valve 315 is also opened. During the subsequent single-axis centrifugation, the washing fluid W is driven out of the washing container 301. The opening and closing of the valve 315 can, for example, be undertaken by a handling unit (robot). Alternatively, it is also conceivable to design the valve 315 such that it opens automatically by virtue of the centrifugal forces occurring (only) during the single-axis centrifugation.

Figure 6A:
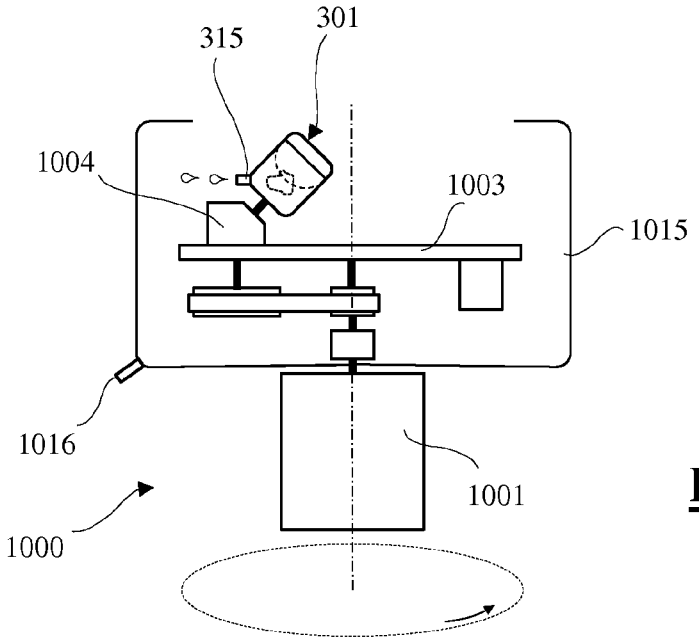
FIGS. 6*a*-6*b* a schematic representation of two detail variants of the washing device.
Figure 6B:
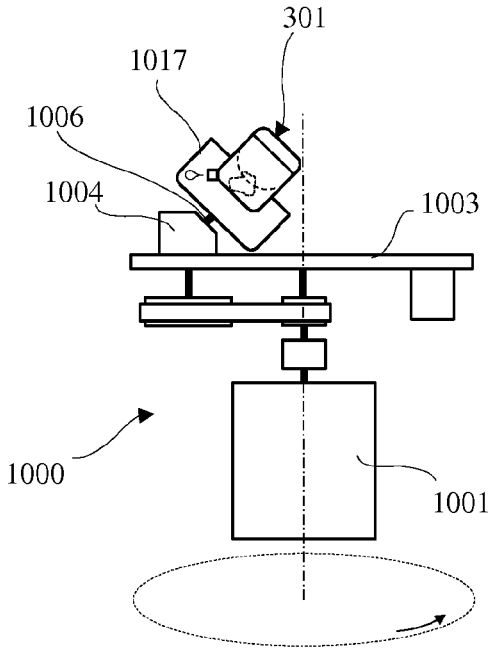

FIGS. 6*a* and 6*b* show schematically how the washing fluid driven out of the washing container 301 is collected. In accordance with FIG. 6*a*, the washing device is fitted with a tub 1015 for this purpose, which surrounds the rotary plate 1003 and all the parts of the device arranged on the latter, including the washing container 301, and possesses a drain 1016.

In the embodiment of FIG. 6*b*, a smaller tub 1017 is provided, which is only arranged around the washing container 301. The tub 1017 can be arranged such that it rotates with the washing container 301, or that it is stationary with respect to the angled gear unit 1004.

For test washings in the research and development sector, which are concerned, for example, with the examination of the effectiveness of detergents (active wash substances and mixtures of substances) in connection with various textile substrates, it is often desirable that the laundry items after the washing process are present in a fixed or planar form, that is to say not crumpled, or are washed in a fixed or planar state, because by this means the measurements on the laundry items can be executed more simply without any further preparatory measures. This can be achieved with the washing method according to the invention based on dual asymmetric centrifugation without any further effort, since hereby the laundry items do not necessarily have to be moved relative to the washing container. In accordance with an advantageous embodiment of the washing method according to the invention, the laundry items are therefore arranged fixed, in particular planarised, in the washing container, and in the fixed or planarised state are dual asymmetrically centrifuged and washed. For this purpose, a suitable design of the washing container is required.

Figure 7:
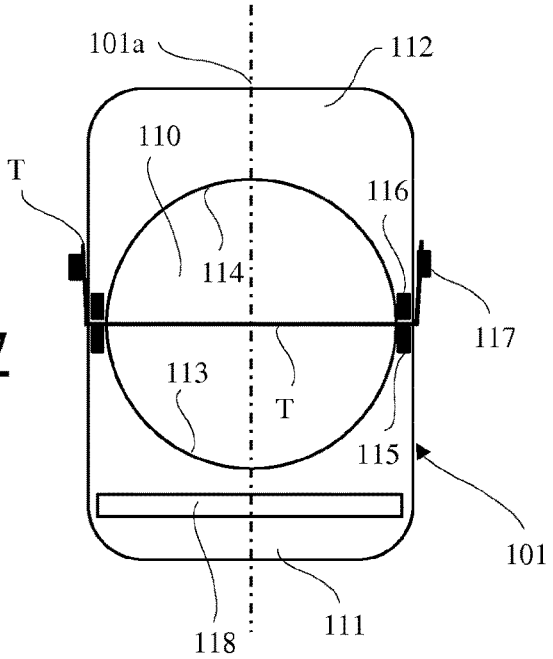
FIG. 7 a schematic representation of a washing container of the washing device.

In FIG. 7 a washing container 101 specially designed for this purpose is schematically represented. Externally, the washing container 101 once again has an essentially cylindrical form with an axis 101*a* and is divided approximately centrally into two container sections 111 and 112, which for purposes of opening the washing container 101 are taken apart, and for purposes of closing the washing container are connected with one another in a sealed manner by means of connecting means that are not represented. In the interior of the washing container 101, two approximately hemispherical shells 113 and 114 are formed, which in between themselves form an essentially spherical washing cell 110. The two container sections 111 and 112 of the washing container 101 are of solid design and each has a sealing ring 115 and 116, respectively, on the annular edge surfaces that face each other.

For the execution of the washing method the textile laundry items T are spanned over the annular edge surface of one of the two container sections, in the example represented the upper container section 112, and the projecting edge of the laundry items is, for example, by means of an elastic belt 117, clamped tightly externally onto the container section 112. Then, after filling the lower container section 111 with washing fluid, the upper container section 112 is placed onto the lower container section 111 and the two container sections 111 and 112 are connected together in a sealed manner by connecting means that are not represented. The textile laundry items T are then spanned across the washing cell and within the washing cell they are essentially flat, i.e. planar. The washing container 101 is then subjected to the dual asymmetric centrifugation, as described in connection with FIG. 2, whereby the textile laundry items are washed in a fixed state, here in particular in a planarised i.e. planar, state.

The washing container 101 of FIG. 7 is additionally fitted with a heating means 118, by means of which the temperature of the washing fluid W in the washing cell 110 can be influenced or adjusted. Depending upon the application, as an alternative to a heating means, a cooling means can also be present. Furthermore, the washing container 101 can also be fitted both with a heating means and with a cooling means.

Figure 10:
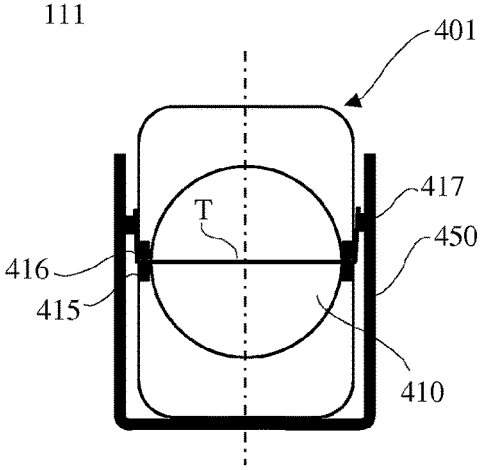

In the embodiment schematically represented in FIG. 10, the washing container 401 having one washing cell 410 is provided with a thermally insulating jacket 450. Before the dual asymmetric centrifugation, the washing fluid in the washing container 401 is brought up to a desired temperature and held approximately constant during the washing process by the thermal insulation of the washing container 401. Once again, sealing rings are designated with 415 and 416, respectively, and an elastic belt is designated with 417.

Figure 11:
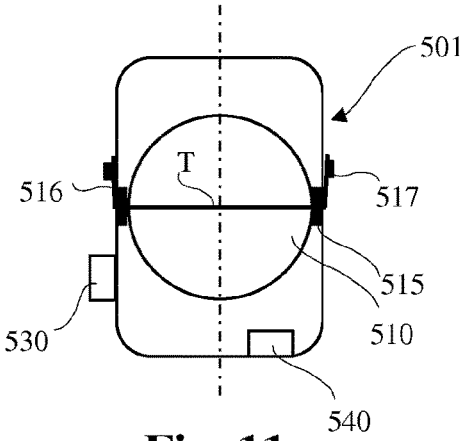
FIGS. 10-11 schematic representations of two further variants of a washing container, and in FIGS. 12*a*-12*b* a further washing container in two functional positions.

In a further embodiment, the washing container 501 having one washing cell 510, as represented in FIG. 11, is also fitted with an external temperature logger or a suitable temperature probe 530, and/or with an internal temperature logger or a suitable temperature probe 540. Thus, the profile of the temperature of the washing fluid can be recorded during the washing process. Once again, sealing rings are designated with 515 and 516, respectively, and an elastic belt is designated with 517.

For purposes of enhancing the washing effect, an inert granular material G forming washing bodies, for example, glass spheres or beads with a diameter of approximately 2-4 mm, can be introduced into the washing cell 10 or 310 of the washing container 1 or 301, respectively, or in principle into each embodiment of the washing container, as is schematically represented in FIG. 1 and FIG. 5*a*.

In the example shown in FIG. 7, the washing cell 110 of the washing container 101 is designed in the form of a sphere. The washing cell 110 can, however, also have another shape, for example an ellipsoidal or a double parabolic shape, etc. Continuously curved, smooth interior walls of the washing cell are in general advantageous with respect to the washing effect that can be achieved. It is advantageous that the washing container is closed. However, it is also possible for the washing process to be executed in an open washing container. By means of the dual asymmetric centrifugation and with reasonably well-adjusted parameters (rotational velocities and quantity of laundry and washing fluid), the mixture of laundry items and washing fluid is automatically held within a defined region by virtue of the centrifugal forces, which, while they are high, they are also acting to some extent in opposition to one another.

The filling level of the washing cell 110 that is optimal with regard to the washing effect, i.e. the quantity of washing fluid introduced, can be empirically determined in proportion to the shape or volume of the washing cell, and as a function of the rotational velocities about the primary and secondary axes.

In research, a large number of test washing must often be executed, if necessary also under varying conditions, such as, for example, varying washing fluids, temperatures, substrates to be washed, etc. Thereby, for reasons of time, it is desirable if as many test washing as possible can be executed simultaneously. This can be achieved by means of a further advantageous embodiment of the washing method according to the invention, in which a washing container with a plurality of washing cells is deployed. FIGS. 8 and 9 show schematically an exemplary embodiment of a suitable washing container with a plurality of washing cells, wherein FIG. 9 represents a cross-section along the line IX-IX of FIG. 8.

The washing container, the whole of which is designated as 201, has once again an external form that is essentially cylindrical with an axis 201*a*, and comprises four essentially disk-shaped modules 220, which are stacked one above another, and are, or can be, connected with one another in a detachable manner. Each module 220 has on each, its upper surface and on its lower surface, twelve approximately hemispherical recesses 213 and 214, wherein the recesses of adjacent modules together form a washing cell 210 in each case. The washing container 201 thus comprises (in the example shown) a total of 3*12=36 washing cells 210, which are arranged in three planes located one above another within the washing container 201. The number of washing cells can, of course, be adapted to the particular conditions of use. Thereby, it is important that all washing cells are located in the optimal mixing region of the appropriately deployed dual asymmetric washing device, that is to say, with regard to its axis designs and axis parameters, and/or that all washing cells are arranged around the optimal mixing centre point of the dual asymmetric washing device as deployed.

Each module 220 has on each, its upper surface and on its lower surface, a sealing ring 215 and 216, respectively, which sealing rings in each case surround all the recesses 213 and 214, respectively. Furthermore, each module 220 is fitted with a heating means 218 (and/or a cooling means).

The textile laundry items T are spanned in three separate parts, each between two adjacent modules 220, such that they are planar within the individual washing cells 210. In this variant of the method, glass beads, or another inert granular material, can also be introduced into the washing cells for purposes of increasing the washing effect.

The same washing fluid can be introduced into all the individual washing cells 210 of the washing container 201. Alternatively, however, different washing fluids can also be used in each washing cell, or in some washing cells. Likewise, the laundry items in the individual washing cells can be the same or different, wherein it is preferable if the laundry items in washing cells arranged in a common plane are in each case the same.

The washing method with a washing container 201 with a plurality of washing cells 210 allows the simultaneous execution of (test) washings in series, under different, or also the same, washing conditions.

With regard to the shape of the washing cells 210 and their filling level, the same considerations apply in a manner corresponding to those stated in connection with the washing container 101 represented in FIG. 7.

After a dual asymmetric centrifugation, that is to say the actual washing process, has been completed in a manner analogous to FIG. 2, the washing fluid is discharged out of the washing container or out of its washing cell or washing cells. For this purpose, the washing container is preferably centrifuged about a single axis of rotation, whereby the washing fluid is driven through pipes or drainage openings that are not represented, either into one or a plurality of collection cavities within the washing container, or into the centrifuge itself. The pipes or drainage openings must be held closed during the washing process, and may only be opened during the final drainage centrifugation. Alternatively, by means of an appropriate arrangement of the drainage flow pipes or drainage openings, it can also be achieved that no washing fluid is driven out during the dual asymmetric centrifugation, but only during the subsequent single-axis emptying centrifugation.

Figure 12A:
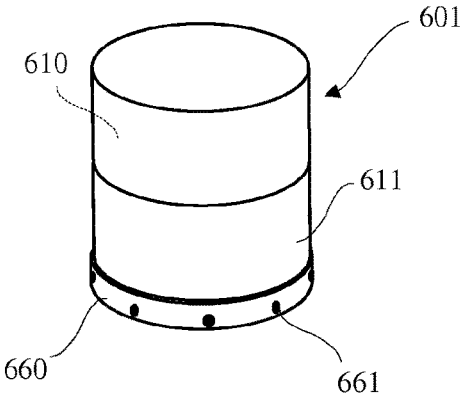
Figure 12B:
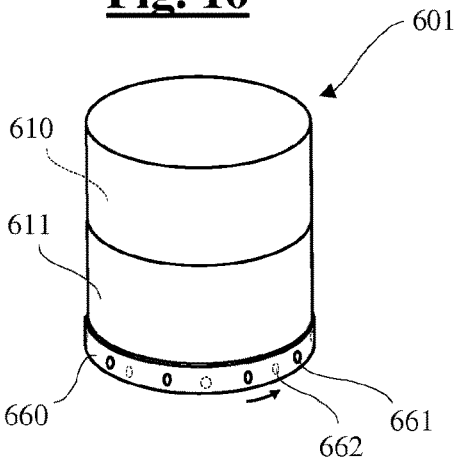

In FIGS. 12*a* and 12*b*, a further embodiment of a washing container is represented. The washing container 601 with a washing cell 610 located in its interior is fitted on the lower edge of its base section 611 with a rotatable closure ring 660 having several openings 661. In the base section 611, drainage openings 662 are arranged, which, in the relative position of the closure ring 660 shown in FIG. 12, are aligned with the openings 661. In this relative position of the closure ring 660, the washing container 601 is open to the external environment. In the relative position of the closure ring 660 shown in FIG. 12*b*, the drainage openings 662 in the base section 611 are covered by the closure ring 660, therefore, the washing container 601 is closed.

Although the above has only been described and represented in connection with the washing containers 201, 301 and 601, drainage openings for purposes of discharging the washing fluid can, needless to say, be installed in all shown embodiments of the washing container.

The invention has been explained with the aid of exemplary embodiments, but shall not to be limited to these exemplary embodiments. Rather, numerous modifications can be conceived by the person skilled in the art, without thereby deviating from the teaching of the invention. The range of protection is therefore defined by the following patent claims.

The invention claimed is:

1. A method for washing textile laundry items, wherein the laundry items and a washing fluid in a ready-to-use form, or in a form of individual components, are introduced into a washing cell of a washing container, wherein the washing container comprises at least one drainage opening opposite to a top opening of the washing container, wherein the at least one drainage opening can be closed and opened, for discharging washing fluid from the washing container, wherein the washing container loaded with the laundry items and the washing fluid is dual asymmetrically centrifuged, and wherein the washing container is rotated about a primary axis running outside of the washing container, and simultaneously about a secondary axis running through the washing container and being arranged at an acute angle to the primary axis, and wherein thereafter the at least one drainage opening is opened and the washing container is centrifuged such that the washing fluid is drained through the at least one drainage opening at least in part through centrifugal force.

2. The method according to claim 1, wherein the laundry items are arranged in a locally fixed manner in the washing container, and are washed in a fixed state.

3. The method according to claim 1, wherein the laundry items are arranged in a planarized manner in the washing container, and are washed in a planarized state.

4. The method according to claim 1, wherein the laundry items are spanned in the washing container such that within the washing cell of the washing container they are essentially planar.

5. The method according to claim 1, wherein a washing container provided with two or more washing cells is used, into which washing cells the laundry items and the washing fluid are introduced in each case.

6. The method according to claim 5, wherein the washing cells are arranged within the washing container in two or more planes.

7. The method according to claim 5, wherein at least partially different washing fluids and/or at least partially different laundry items are introduced into the washing cells.

8. The method according to claim 5, wherein an inert granular material is introduced into the washing cells.

9. The method according to claim 8, wherein the inert granular material is in the form of glass beads.

10. The method according to claim 1, wherein the temperature of the washing fluid in the washing container is controlled during a washing process.

11. The method according to claim 1, wherein a thermally insulated washing container is used, wherein the temperature of the washing fluid in the washing container is adjusted to a set value before a washing process, and wherein the temperature of the washing fluid is held essentially constant during the washing process.

12. The method according to claim 1, wherein a profile of the temperature of the washing fluid in the washing container is recorded during a washing process.

13. The method according to claim 1, wherein the washing fluid is discharged from the washing container by single-axis centrifugation after the washing.

14. The method according to claim 13, wherein the at least one drainage opening is held open during the single-axis centrifugation.

15. The method according to claim 13, wherein a washing process is executed in a device centrifuging in a dual asymmetric manner about two axes, wherein the discharging of the washing fluid is executed in the same device after the washing process, and wherein during the discharging of the washing fluid the device only centrifuges about one of the two axes.

16. A device for washing textile laundry items, comprising:

a washing container for accommodating the laundry items and a washing fluid in a ready-to-use form or in a form of individual components, wherein the washing container has at least one drainage opening, which can be closed and opened, for discharging the washing fluid from the washing container, and wherein the washing container has means for fixing the laundry items, means for mounting the washing container, and means for dual asymmetric centrifugation of the washing container about a primary axis and a secondary axis, and wherein the primary axis runs outside of the washing container, and the secondary axis runs through the washing container and is arranged at an acute angle to the primary axis, wherein the at least one drainage opening is opposite to a top opening of the washing container such that when the washing container is being subject to centrifugation and the at least one drainage opening is open, then the washing fluid is drained through the at least one drainage opening at least in part through centrifugal force.

17. The device according to claim 16, configured to be switchable between a first and a second mode of operation, wherein in the first mode of operation the washing container rotates about both axes, and wherein in the second mode of operation the washing container only rotates about one of the two axes.

18. The device according to claim 16, further including first drive means for a rotative drive of the washing container about the primary axis, and second drive means, which can be coupled with and decoupled from the first drive means, for a rotative drive of the washing container about the secondary axis.

19. The device according to claim 16, wherein the means for fixing the laundry items are means for fixing the laundry items in a planarized manner.

20. The device according to claim 16, wherein the washing container has two or more washing cells for accommodating the laundry items and the washing fluid.

* * * * *